US005622091A

United States Patent [19]

Crook et al.

[11] Patent Number: 5,622,091

[45] Date of Patent: Apr. 22, 1997

[54] VALVED BOX ADJUSTING TOOL

[75] Inventors: James E. Crook, Mishawaka; Joseph R. Zirille, Granger, both of Ind.

[73] Assignee: T-Rex, Inc., Mishawaka, Ind.

[21] Appl. No.: 509,826

[22] Filed: Aug. 1, 1995

[51] Int. Cl.[6] ..... B25B 23/08

[52] U.S. Cl. ..... 81/441; 81/446

[58] Field of Search ..... 81/441, 446

[56] References Cited

U.S. PATENT DOCUMENTS 138,568 5/1873 Littlejohn ..... 81/446

2,573,327 10/1951 Gossard ..... 81/446

5,129,291 7/1992 Poniatowski ..... 81/446

*Primary Examiner*—James G. Smith

*Attorney, Agent, or Firm*—Baker & Daniels

[57] ABSTRACT

A tool for adjusting threaded valve boxes that grips the valve box from the inside. The present tool allows valve boxes to be rotated without having to excavate in the vicinity of the valve box, and thus allows valve boxes to be quickly and easily adjusted prior to or after paving. The tool is easily adaptable to a power-take-off unit, and automatically engages the valve box upon rotation of the shaft.

7 Claims, 6 Drawing Sheets

VALVED BOX ADJUSTING TOOL

BACKGROUND OF THE INVENTION

This invention relates to a tool for rotationally adjusting threaded valve boxes.

In the typical urban environment a vast network of gas lines, oil lines, water lines, and the like run underneath the ground. Interspersed throughout the network is a number of valves for adjusting line pressure or for closing off portions of the lines for maintenance and other purposes. In order to access the valves, a metal pipe, typically called a valve box, is located at each valve and runs vertically to the surface. To open or close the valve, a long tool having a fitting that engages the valve is inserted down through the valve box so that the valve can be turned in the desired direction. In order to protect the valve, the valve box normally includes a protective cap that covers the vertical opening to prevent dirt and/or water from entering the valve box. The upper portion of the valve box typically includes a counterbore having a slightly angled or sloped sidewall that forms a seat for the protective cap. The sidewall of the protective cap is shaped to conform to the size and slope of the counterbore, which helps to prevent the protective cap from bouncing out when cars or other traffic runs over the valve box.

The gas and/or water lines are usually owned or maintained by utilities or municipalities and are normally routed along public rights of way, i.e. under the streets. Because the streets are periodically repaved or regraded, the height of the valve box must be adjusted in order to avoid having a bump or a hole where the valve box is located. Therefore, in place of a one piece valve box, municipalities normally use a two piece threaded valve box that can be threaded up or down so that the elevation of the protective cap matches the grade of the street. When a street is repaved, the contractor first scarifies the pavement in order to remove the top level of aggregate. Before scarifying, the upper portion of the two piece valve box must be lowered in order to avoid damage to the valve box, the protective cap, or the scarifying machine. After repaving is complete, the upper portion of the valve box must be raised so that the elevation of the top of the valve box matches the final grade of the street.

In the past, standard pipe wrenches and other tools have been used to adjust the valve box. These tools require that the street be excavated around the valve box and are, accordingly, very labor intensive and time consuming. Further, some tools used in the prior art fail to adequately grip the valve box, hence damaging the valve box or waste time by requiring re-adjustment of the tool.

The tools presently available require excavation around the valve box, and also require that the operator first attach the tool to the valve box, for example, by set screws before the valve box can be adjusted. While such prior art tools are being positioned and attached, the valve box is open and hence vulnerable to the entry of dirt and other contaminants.

SUMMARY OF THE INVENTION

The tool of the present invention adjusts the valve box up or down without excavation, and at the same time prevents the entry of dirt or other contaminants into the valve box while the valve box is being adjusted. Also, because the tool according to the present invention grips only the inner circumferential surface of the valve box, no excavation is required to engage the tool with the valve box. Finally, the tool according to the present invention is easily operated by a power drive unit.

The tool according to the present invention utilizes a pair of semicircular engagement members, a cam for spreading the engagement members, and a handle for rotating the cam. Upon rotation of the handle, the cam thrusts the engagement members outwardly into engagement with the inner surface of valve box. The engagement members, which are preferably case hardened for durability, include serrations on the outer circumferential edges that grip the inner surface of the valve box. Each engagement member also has a smooth, semi-elliptically shaped cutout, which, when the engagement members are placed together, form an elliptical void that substantially conforms to and surrounds the elliptical cam. Thus, prior to rotation of the shaft the elliptical cam exerts no force on the engagement members. Upon rotation of the shaft, the cam contacts the smooth inwardly facing camming surface of the engagement members, which forces the engagement members outwardly so that the serrated outer edges of the engagement members are forced into contact with the inner surface of the valve box. Further rotation of the shaft creates a strong frictional connection between the serrated engagement members and the inner surface of the valve box, so that the cam, the engagement members, and the upper portion of the valve box rotate in conjunction with the shaft, thus raising or lowering the elevation of the valve box. The tool includes a cover plate that covers the vertical opening in the valve box, and further includes a retention plate that allows the engagement plates to tilt up or down in order to conform with the sloped inner surface of the valve box, which ensures that the serrations make full contact with the valve box.

Accordingly, it is an object of this invention to provide a valve box adjusting tool that does not require fasteners to secure the tool to the valve box.

Another object of this invention is to provide a valve box adjusting tool that is easier to use and therefore requires less labor than prior art devices.

A still further object of this invention is to provide a valve box adjusting tool that is easily adaptable for operation by a power drive unit.

Other objects of the invention will become readily apparent to those skilled in the art upon a reading of the following description.

DESCRIPTION OF THE PREFERRED EMBODIMENT

Figure 1:
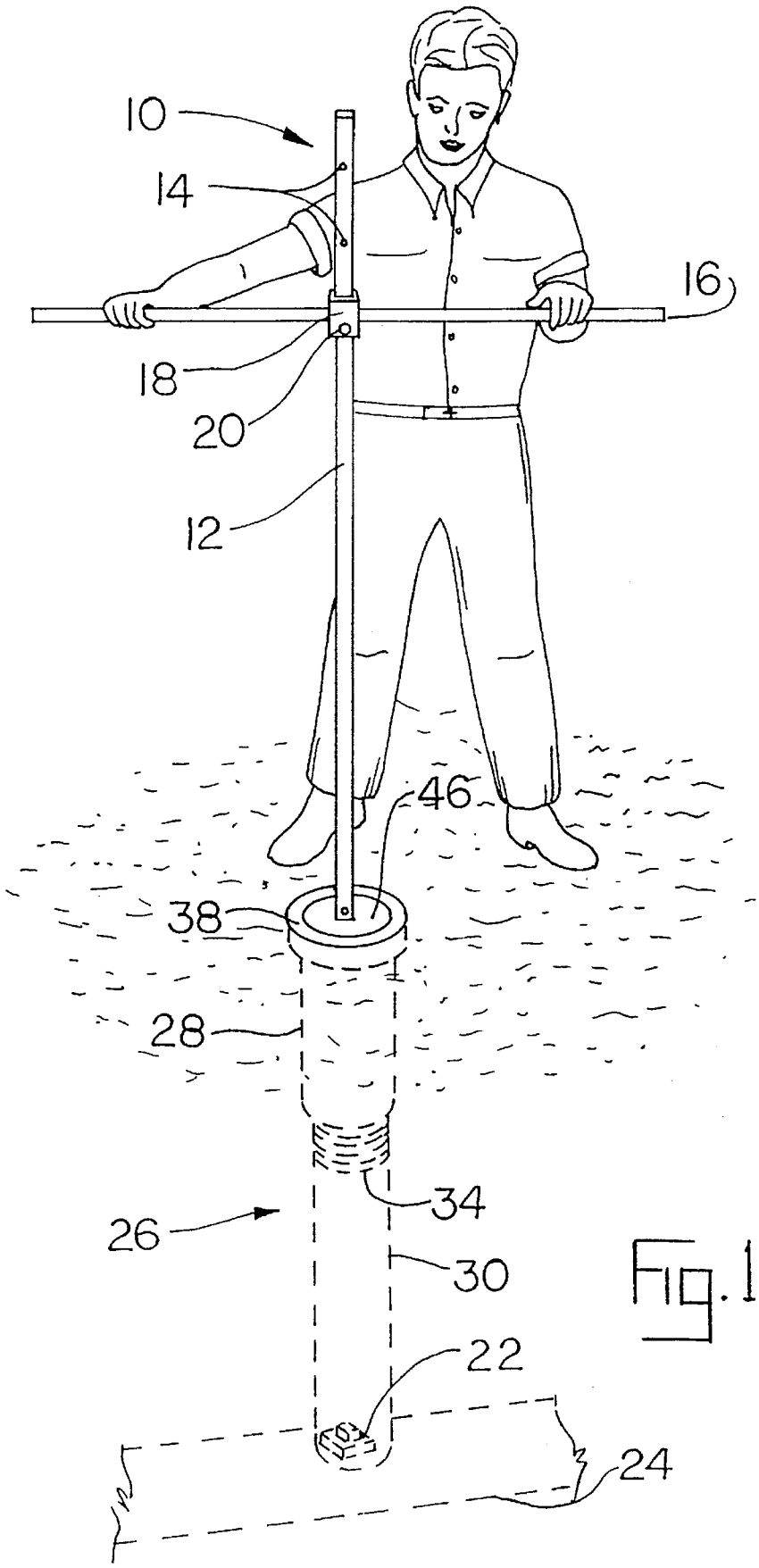
FIG. 1 is a perspective view of a valve box adjusting tool made pursuant to the present invention being used by an operator to adjust a threaded valve box providing access to a valve controlling a buried pipe system.
Figure 2:
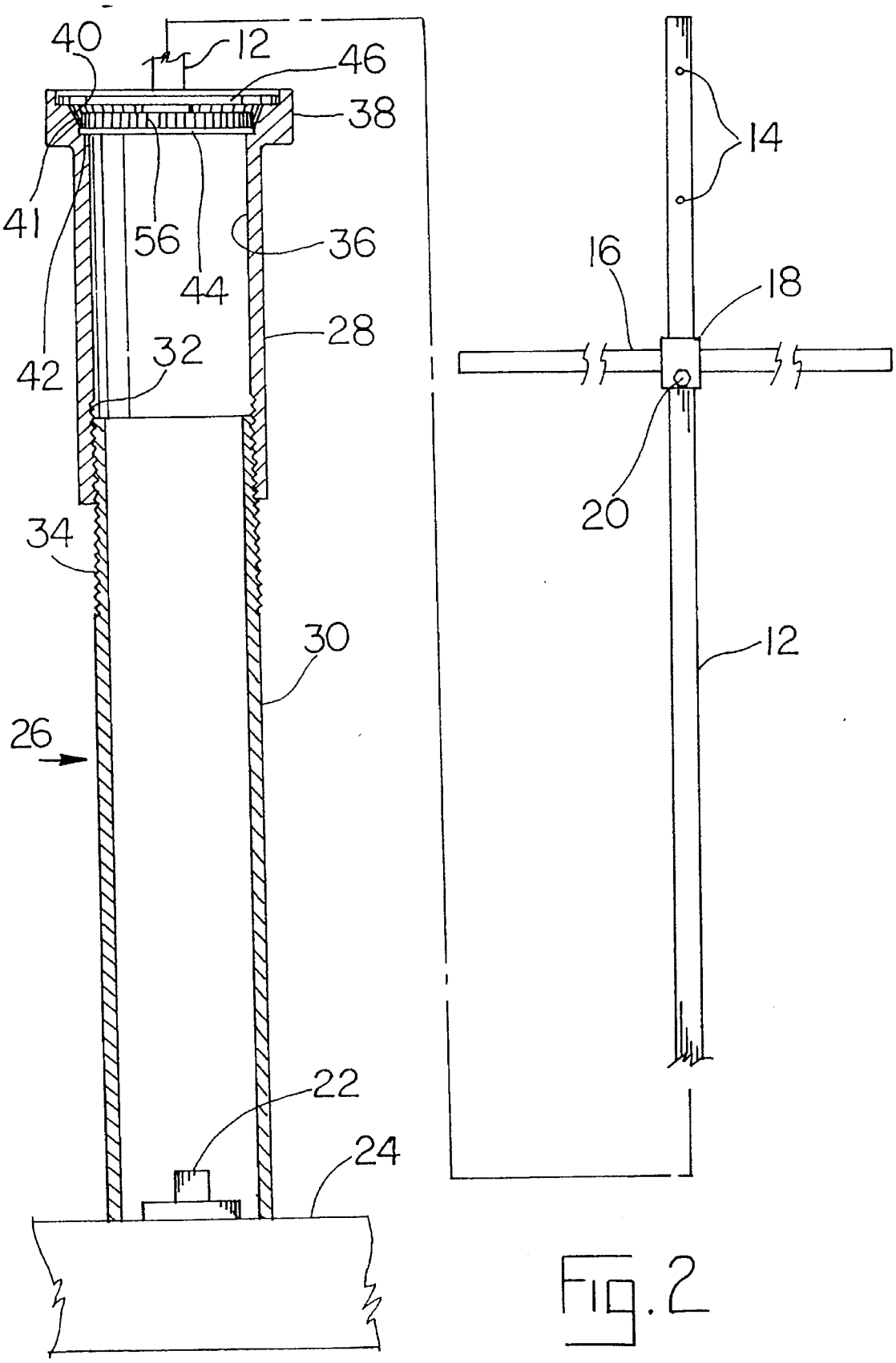
FIG. 2 is a cross-sectional view of the valve box and valve box adjusting tool shown in FIG. 1.

The preferred embodiment herein described is not intended to be exhaustive or to limit the invention to the precise form disclosed. It is chosen and described to explain the principles of the invention and its application and practical use to best enable others skilled in the art to follow its teachings.

Referring now to the drawings, a valve box adjusting tool according to the present invention is generally indicated by the reference numeral 10. The tool 10 includes a shaft 12, which has a plurality of adjustment holes 14 spaced at intervals along the shaft, and a handle 16, which is adjustably attached to shaft 12 through one of the adjusting holes 14. Handle 16 includes tubular part 18, which slides over shaft 12 and is fixed in place with a link pin 20 inserted into one of the adjustment holes 14.

A valve 22 is positioned in a buried pipeline 24. A valve box 26 is permanently installed over valve 22 to provide access to the valve from the street so that an operator may operate the valve 22 to permit, prevent, or adjust the flow of water, petroleum or other materials through pipe 24. Valve box 26 includes a pair of threadingly interconnected, relatively rotatable members 28, 30. Member 28 includes a threaded inner surface 32 which threadingly engages a threaded outer surface 34 of member 30 so that rotation of member 28 relative to member 30 causes member 28 to be raised or lowered. Member 28 includes a bore 36 which extends upwardly from the threaded section 32 and terminates in a counterbore 40 which is defined within a circumferentially extending radially outwardly projecting lip 38. Counterbore 40 typically includes a sloped inner surface 41, and the shoulder between counterbore 40 and bore 36 defines an annular seat 42. Normally, the upper surface 37 of lip 38 is substantially flush with the elevation of the grade 39.

The lower end of shaft 12 includes a pair of parallel limiting plates 44, 46 defining a space 48 therebetween. First plate 44 is sized to fit into counterbore 40 so that first plate 44 rests on annular seat 42 thus covering bore 36. Elliptical expansion cam 50 is attached to shaft 12 in the space 48 between first plate 44 and second plate 46, and a pair of engagement members 52 are removably disposed in space 48 between the pair of limiting plates 44, 46. The engagement members 52 are substantially semicircular in shape with an outer circumferential edge 54 having a plurality of serrations 56, and each member 52 has a semi-elliptically shaped cutout 53 that defines a smooth inwardly facing camming surface 58. When the engagement members are placed together in the space 48 adjacent the elliptical expansion cam 50, the semi-elliptically shaped cutouts 53 on members 52 define an elliptically shaped void which accommodates expansion cam 50 therein. The engagement members 52 as well as the elliptical expansion cam 50 are preferably case hardened for durability. The engagement members 52 are placed in space 48 between first plate 44 and second plate 46, so that when tool 10 is placed in counterbore 40 the sloped inner surface 41 of counterbore 40 lies in close proximity to the serrations 56 on the outer edges 54 of members 52.

Figures 3, 4:
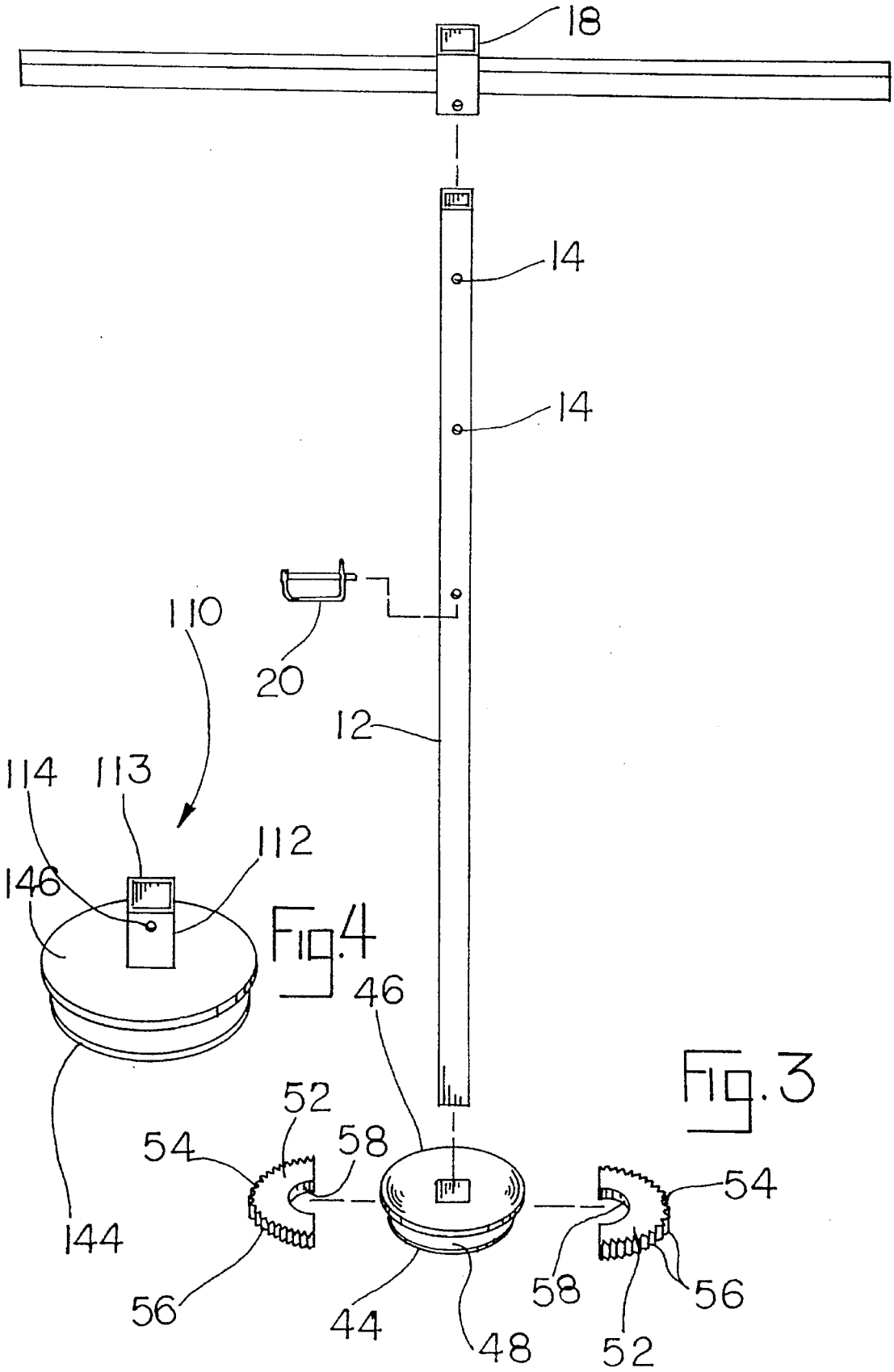
FIG. 3 is an exploded view in perspective of the valve box adjusting tool shown in FIGS. 1 and 2.
FIG. 4 is a perspective view of another embodiment of the valve box adjusting tool made pursuant to the present invention which is adapted for use on a power drive unit.

FIG. 4 illustrates a second embodiment of the claimed invention, in which the elements are the same or substantially the same as those in the embodiment of FIGS. 1–3 and 5–8 and retain the same reference characters, but increased by 100.

Tool 110 is adapted for use with a power drive unit (not shown). Tool 110 includes a shaft 112, which has one or more adjustment holes 114 spaced at intervals along the shaft. The upper end of shaft 112 includes a power drive fitting 113, so that the output shaft of the power drive unit (not shown) can be secured directly to shaft 112 and secured by a locking pin or similar means (not shown) to locking hole 114. First and second limiting plates 144, 146 are secured to shaft 112.

In operation, the engagement members 52 and the handle 16 may be removed from shaft 12 and carried separately to the job site. To prepare the tool for use, the operator slides the tubular part 18 of handle 16 down shaft 12 to the desired operating level, and secures the handle in place by inserting pin 20 through adjusting hole 14. The engagement members 52 are then placed in the space 48 between first and second limiting plates 44, 46 so that the serrations 56 on the outer circumferential edges 54 face outwardly and the semi-elliptically shaped cutouts 53 face inwardly adjacent the elliptical expansion cam 50, so that the elliptical void defined by cutouts 53 accommodates the cam 50 therein.

Figure 5:
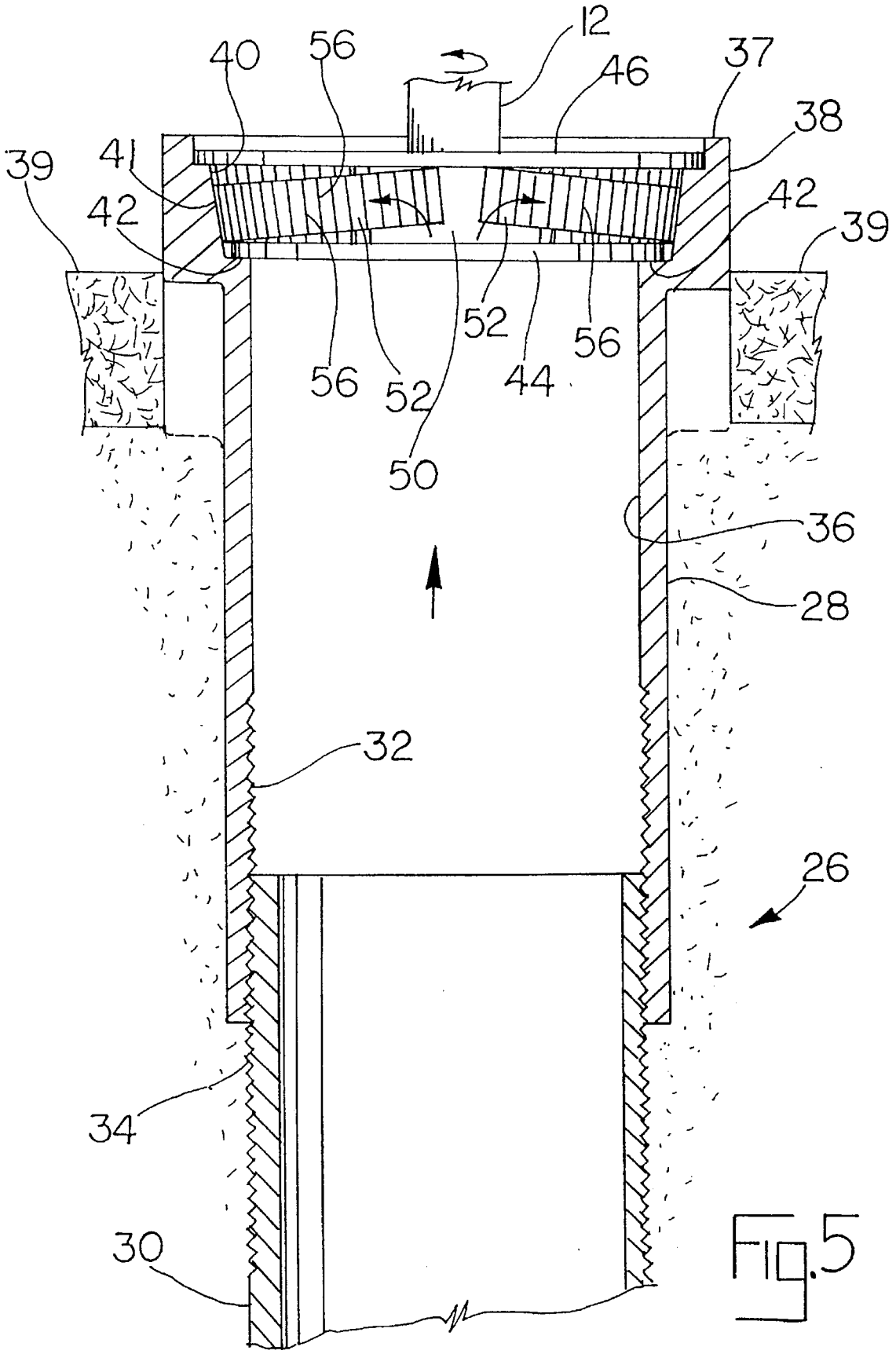
FIG. 5 is a fragmentary cross-sectional view of the valve box and the valve box adjusting tool illustrated in FIGS. 1–3, illustrating the manner in which the engagement plates of the adjustment tool are brought into contact with the sloped inner of a threaded valve box.
Figure 6:
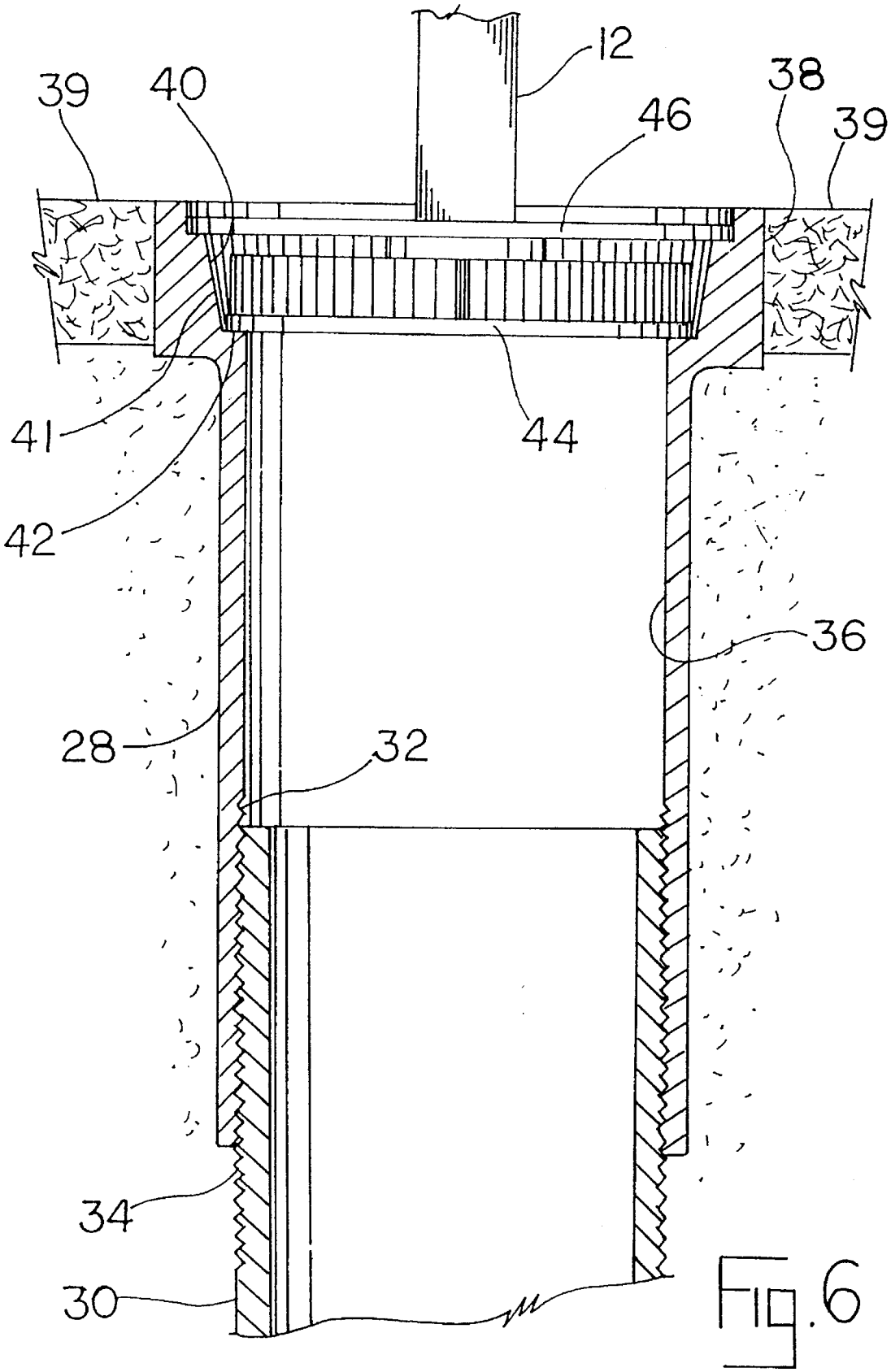
FIG. 6 is a fragmentary cross-sectional view similar to FIG. 5 but illustrating the adjusting tool with the engagement plates not yet engaged with the valve box.
Figure 8:
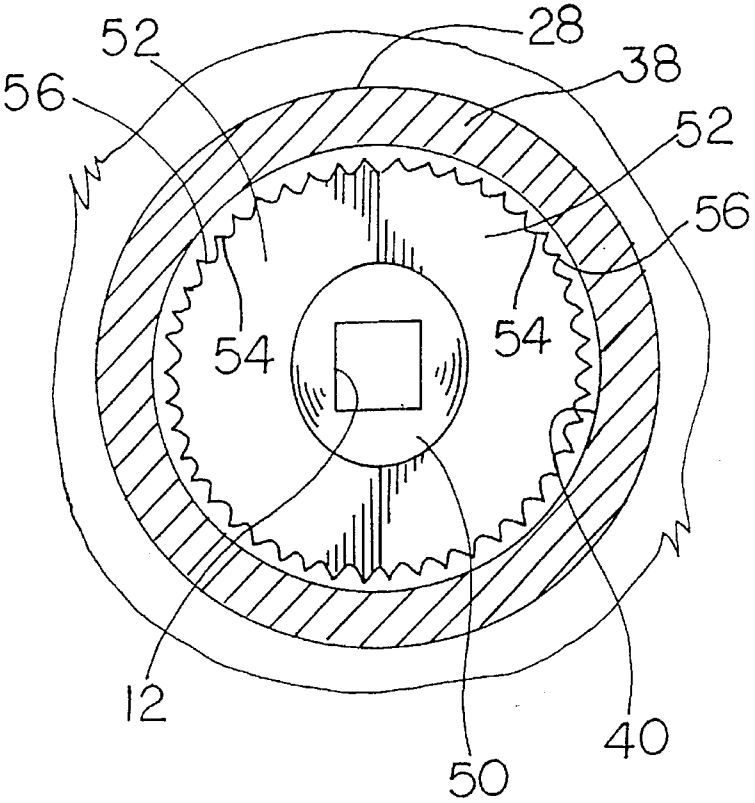
FIG. 8 is a plan view taken substantially along line 8—8 of FIG. 6, with the engagement plates not yet engaged with the valve box.
Figure 7:
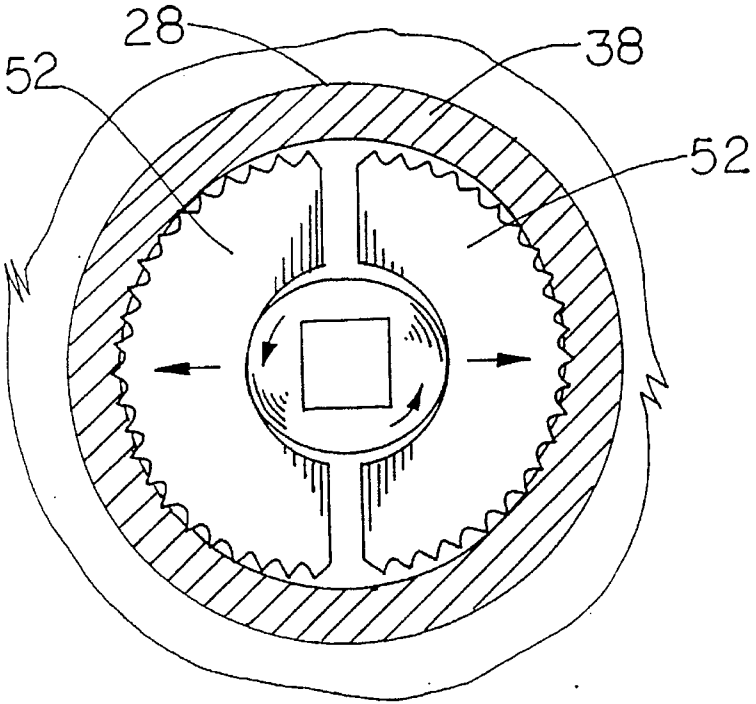
FIG. 7 is a cross-sectional view taken substantially along line 7—7 of FIG. 5.

After removal of the protective cap (not shown) normally covering the valve box, the tool 10 is placed in the adjustable valve box as shown in FIGS. 1 and 5. With the handle 16 and the engagement members 52 in place, the tool 10 is oriented over the valve box 26 and inserted down into the counterbore 40 so that the first limiting plate 44 rests on annular seat 42. The serrations 56 of engagement members 52 are thus in close circumjacent proximity to the sloped inner surface 41 of counterbore 40 substantially as shown in FIGS. 6 and 8. The operator holds the tool 10 so that shaft 12 remains substantially perpendicular to bore 36 of valve box 26, and using handle 16 for leverage rotates the tool 10 in the desired direction. As shown in FIG. 7, the elliptical expansion cam 50 engages the camming surface 58 of engagement members 52, thus forcing the engagement members outwardly so that the serrations 56 of outer surface 54 come into contact with the inner surface 41 of counterbore 40. As shown in FIG. 5, the space 48 between first and second limiting plates 44, 46 allows the engagement members 52 to tilt slightly, which allows the angle of serrations 56 to conform to the slope of inner surface 41. At the same time, upper limiting plate 46 prevents engagement members 52 from exceeding the maximum desired angle, and therefore the engagement members 52 will not pop out of position. Thus, adequate contact between the serrations 56 and the sloped inner surface 41 of counterbore 40 is assured. As the operator continues to rotate shaft 12, the frictional connection between the engagement members 52 and the sloped inner surface 41 becomes so great that member 28 begins to rotate in conjunction with shaft 12, while member 30 remains stationary. The rotation of member 28 relative to member 30 causes member 28 to be raised or lowered until the upper surface 37 of lip 38 is at the desired elevation.

It is understood that the above description does not limit the invention to the above-given details, but may be modified within the scope of the following claims.

What is claimed:

1. A tool for adjusting a valve box by rotating one of a pair of relatively rotatable members relative to the other member, said tool comprising a shaft, expandable engagement means for engaging the inner surface of one of said relatively rotatable members for rotating said one member relative to the other member to effect adjustment of the valve box by rotation of the shaft, and expanding means connecting the shaft and the engagement means and responsive to rotation of the shaft for expanding said expandable engagement means into gripping engagement with said one member, said engagement means including a pair of semi-circular engagement members, said engagement members having a serrated outer circumferential surface for engaging the inner surface of said one member, said engagement members further including a camming surface for engagement by said expanding means, said engagement means further including limiting means for limiting the vertical movement of said engagement members, said limiting means including a first plate and a second plate attached substantially perpendicular to said shaft in spaced apart parallel relationship, said plates defining a space therebetween, said engagement members being slidably mounted in said space between said plates for allowing said engagement members to move freely in a substantially horizontal direction, said space between said plates being greater than the thickness of the engagement members to permit the engagement members to tilt relative to the plates to thereby conform to variations in slope on the inner surface of said one member.

2. A tool as claimed in claim 1, wherein said shaft includes a handle, said handle being movable to a plurality of positions on said shaft.

3. A tool as claimed in claim 1, wherein said one member includes a bore, the bore having edges defining an annular seat, said first plate for limiting the insertion of said tool into said bore by contacting said annular seat, said first plate further including covering means for covering said bore for preventing contaminants from entering the bore.

4. A tool as claimed in claim 1, wherein said expanding means includes an elliptical cam attached to said shaft between said first and second plates.

5. A tool as claimed in claim 4, wherein said camming surface of said engagement members defines a substantially elliptically shaped void, said elliptically shaped void substantially conforming to the shape of said elliptical cam so that said void accommodates said cam, so that prior to rotation of said shaft said elliptical cam exerts no force upon said engagement members, and so that upon rotation of said shaft said elliptical cam engages said camming surfaces of said engagement members and thereby urges said engagement members outwardly into contact with the inner surface of said one member.

6. A tool as claimed in claim 4, wherein said engagement members and said elliptical cam are case hardened.

7. A tool as claimed in claim 1, wherein said shaft includes attachment means for attaching a power drive unit to said shaft.

* * * * *

UNITED STATES PATENT AND TRADEMARK OFFICE

CERTIFICATE OF CORRECTION

PATENT NO. : 5,622,091

DATED : April 22, 1997

INVENTOR(S) : James E. Crook, et al.

It is certified that error appears in the above-indentified patent and that said Letters Patent is hereby corrected as shown below:

On the title page, item [54] and column 1, line 2 the title should read as follows:

-- VALVE BOX ADJUSTING TOOL --

Signed and Sealed this

First Day of July, 1997

Bruce Lehman

*Attest:*

BRUCE LEHMAN

*Attesting Officer*

*Commissioner of Patents and Trademarks*